US005199410A

United States Patent [19]

Cheng

[11] Patent Number: 5,199,410

[45] Date of Patent: Apr. 6, 1993

[54] TOY SAUCER LAUNCHING AND CATCHING DEVICE

[76] Inventor: Cheng-Tsuan Cheng, 3F No. 28, Lane 47, Sec. 2, Double Ten Rd., Pan Chiao, Taipei Hsien, Taiwan

[21] Appl. No.: 805,963

[22] Filed: Dec. 12, 1991

[51] Int. Cl.[5] ..... A63B 65/10

[52] U.S. Cl. ..... 124/10; 124/16; 124/31; 124/47; 273/324

[58] Field of Search ..... 124/10, 16, 26, 27, 124/31, 42, 41.1, 47, 1; 273/322, 323, 318, 324, 325, 328

[56] References Cited

U.S. PATENT DOCUMENTS

| | | | |
|---|---|---|---|
| 1,091,739 | 3/1914 | Falker | 273/324 |
| 1,468,004 | 9/1923 | Cavicchioli | 124/16 |
| 3,717,136 | 2/1973 | Gay et al. | 273/322 X |
| 4,170,215 | 10/1979 | Kettlestrings | 124/16 |
| 4,248,202 | 2/1981 | Jaworski et al. | 124/16 |
| 4,277,068 | 7/1981 | Sasaki | 124/10 X |

*Primary Examiner*—Andrew V. Kundrat
*Assistant Examiner*—Jeffrey L. Thompson
*Attorney, Agent, or Firm*—Jacobson, Price, Holman & Stern

[57] ABSTRACT

A toy saucer launching and catching device comprised of a base covered with an upper cover and supported on a handle to hold a saucer seat, a curved spring rod retained between said base and said saucer seat, a push plate controlled by a trigger on said handle to squeeze said spring rods inwards, and a lifting plate controlled by an auxiliary trigger on said handle to lift said upper cover, and wherein pulling said trigger causes a toy saucer to be launched out of said saucer seat into the air; pulling said auxiliary trigger causes said upper cover to be opened for catching a flying toy saucer.

1 Claim, 4 Drawing Sheets

TOY SAUCER LAUNCHING AND CATCHING DEVICE

BACKGROUND OF THE INVENTION

The present invention relates to a toy saucer launching and catching device which has a curved spring rod controlled by a trigger to launch a toy saucer into the air, and a lifting plate controlled by an auxiliary trigger to open an upper cover for catching a flying toy saucer.

In the game of throwing a toy saucer or disk into the air and catching it during its flying, a certain technique is required. While playing the game, much force shall be applied so that a toy saucer or disk can be thrown into the air as far and higher as possible. Therefore, it is not easy to those small children to play the game well. Further, while throwing or catching a toy saucer or disk, the finger may be hurt easily.

SUMMARY OF THE INVENTION

The present invention has been accomplished to eliminate the aforesaid problems. It is therefore the main object of the present invention to provide a toy saucer launching and catching device which can be used to launch a toy saucer and catch a flying toy saucer.

According to the present invention, there is provided a toy saucer launching and catching device which is generally comprised of a base covered with an upper cover and supported on a handle to hold a saucer seat. The cover is pulled by spring means to constantly close the saucer seat. A curved spring rod is retained between the base and the saucer seat and squeezed by a push plate through the control of a trigger to automatically launch a toy saucer out of the saucer seat into the air. A lift plate is controlled by an auxiliary trigger to lift the upper cover for catching a flying toy saucer.

DETAILED DESCRIPTION OF THE PREFERRED EMBODIMENT

Figure 1:
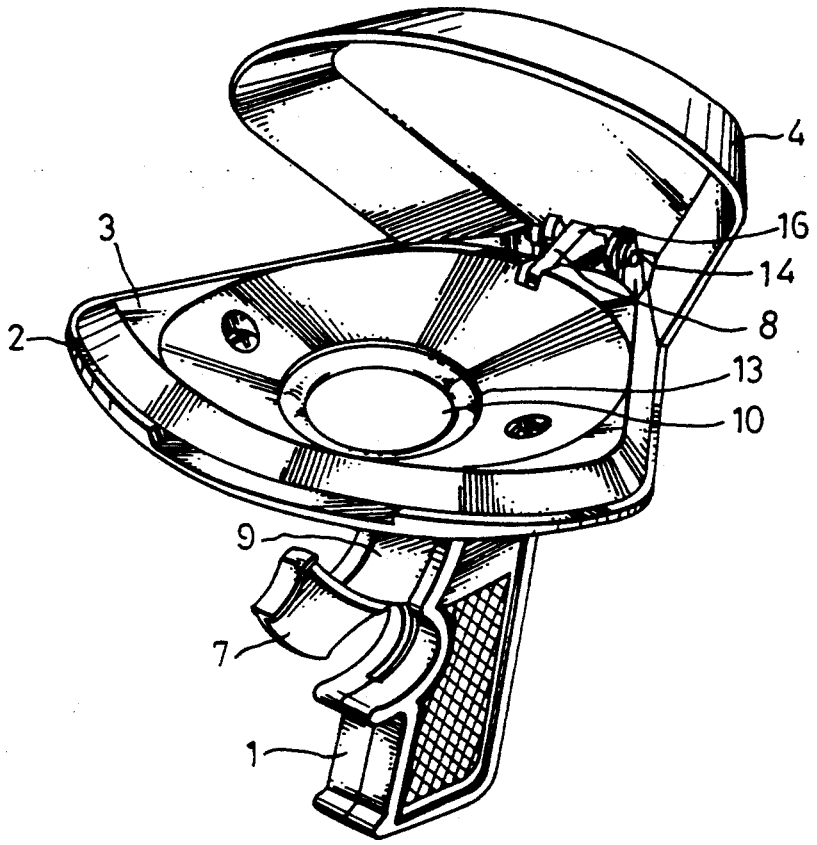
FIG. 1 is a perspective view of a toy saucer launching and catching device embodying the present invention.
Figure 2:
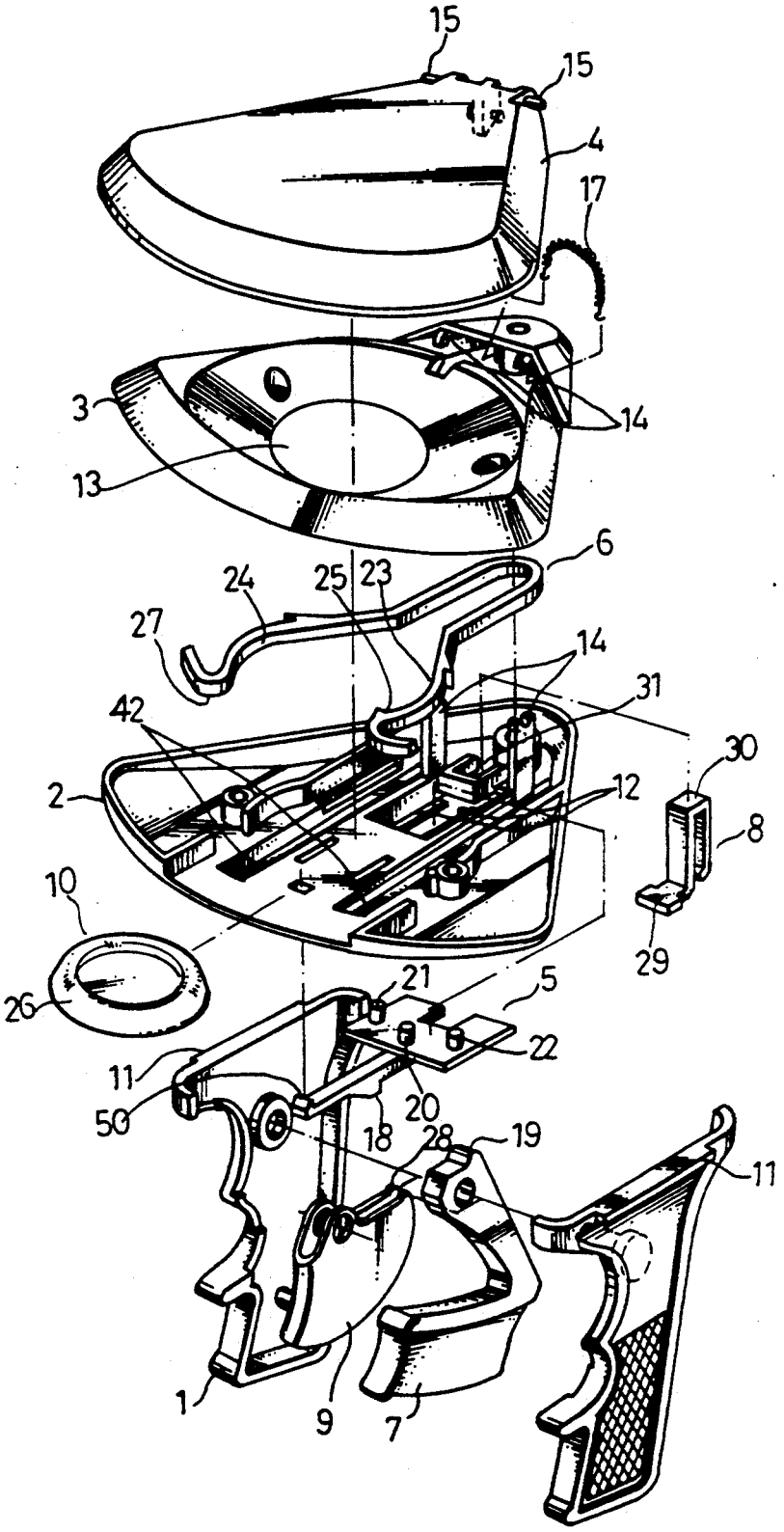
FIG. 2 is an exploded perspective view thereof.
Figure 3:
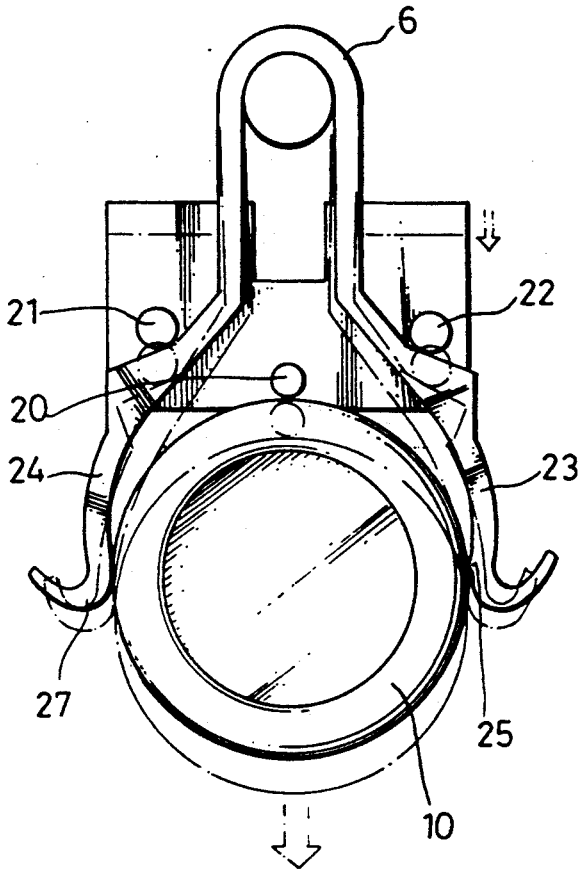
FIG. 3 is a plan view illustrating the operation of the spring rod.

Referring to FIGS. 1 and 2, therein illustrated is a toy saucer launching and catching device embodying the present invention and generally comprised of a handle 1, a base 2, a saucer seat 3, an upper cover 4, a push plate 5, a spring rod 6, a trigger 7, a lifting plate 8, an auxiliary trigger 9, and a plurality of toy saucers 10. The handle 1 is consisted of two plastic shells 11, having two guide rails 11 at a top thereof at two opposite locations for connecting the base 2. The base 2 is shaped like a sector of a circle for holding the push plate 5, the spring rod 6 and a toy saucer 10, having two slots 12 for fastening the two elongated guide rails 11 of the handle 1. The saucer seat 3 is shaped like a sector of a circle and supported on the base 2, having a top edge curving inwards with a round hole 13 defined at the center for guiding a toy saucer 10 into a position to be retained in between two opposite arm portions 23, 24 of the spring rod 6. The upper cover 4 has two opposite pins 15 longitudinally aligned at a rear end thereof respectively pivotably fastened into two axle holders 14 formed of parts of the base 2 and the saucer seat 3, a projecting strip 16 raised from said rear end at a bottom, two springs 17 secured to said projecting strip 16 at two opposite sides and connected to the saucer seat 3 to constantly pull the upper cover 4 into a closed position closing on the saucer seat 3. The push plate 5 is retained between the base 2 and the saucer seat 3 within two guide grooves 42 on the base 2, having a hooked portion 18 on a bottom thereof stopped against a hooked portion 19 on the trigger 7, three circular posts 20, 21, 22 on a top edge thereof. When the trigger 7 is pulled, the hooked portion 18 on the push plate 5 is pushed by the hooked portion 19 on the trigger 7, and therefore, the push plate 5 is moved along the two guide grooves 42 causing the two outer circular posts 21, 22 to squeeze the two arm portions 23, 24 of the spring rod 6 inwards (see FIG. 3). By means of the push force from the middle circular post 20 and the two arm portions 23, 24 of the spring rod 6, a toy saucer 10 which is held in the round hole 13 on the saucer seat 3 is launched into the air. The spring rod 6 is made in a curved shape, having two arm portions 23, 24 shaped like the two claws of a crab, wherein the right arm portion 23 has an inward tooth 25 adjacent to the terminal end thereof engaged into an upper peripheral edge 26 on a toy saucer 10 to hold it in place; the left arm portion 24 has a circular arch 27 stopped against the toy saucer 10 which is held by the inward tooth 25. By means of rubbing against the circular arch 27 of the left arm portion 24 during launching of a toy saucer 10, a toy saucer is caused to rotate while flying into the air. The trigger 7 is fastened in the handle 1, having a hooked portion 19 at a top thereof moved to push the push plate 5 causing the push plate 5 to squeeze the two arm portions 23, 24 of the spring rod 6 so as to launch a toy saucer 10 into the air. The lifting plate 8 is fastened between a raised portion 28 on the auxiliary trigger 9 and a projecting strip 16 on the rear end of the upper cover 4. When the auxiliary trigger 9 is pulled with the finger, the raised portion 28 is moved to push a bottom 29 on the lifting plate 8 upwards, and therefore, the lifting plate 8 is moved upwards in a hole 31 on the rear end of the base 2. When the lifting plate 8 is moved upwards, a top edge 30 on the lifting plate 8 is forced to push the projecting strip 16 causing the upper cover 4 to open. A toy saucer 10 as constructed in accordance with the present invention has a circular flange around the peripheral surface thereof, and a recessed flat surface at the middle.

Figure 4:
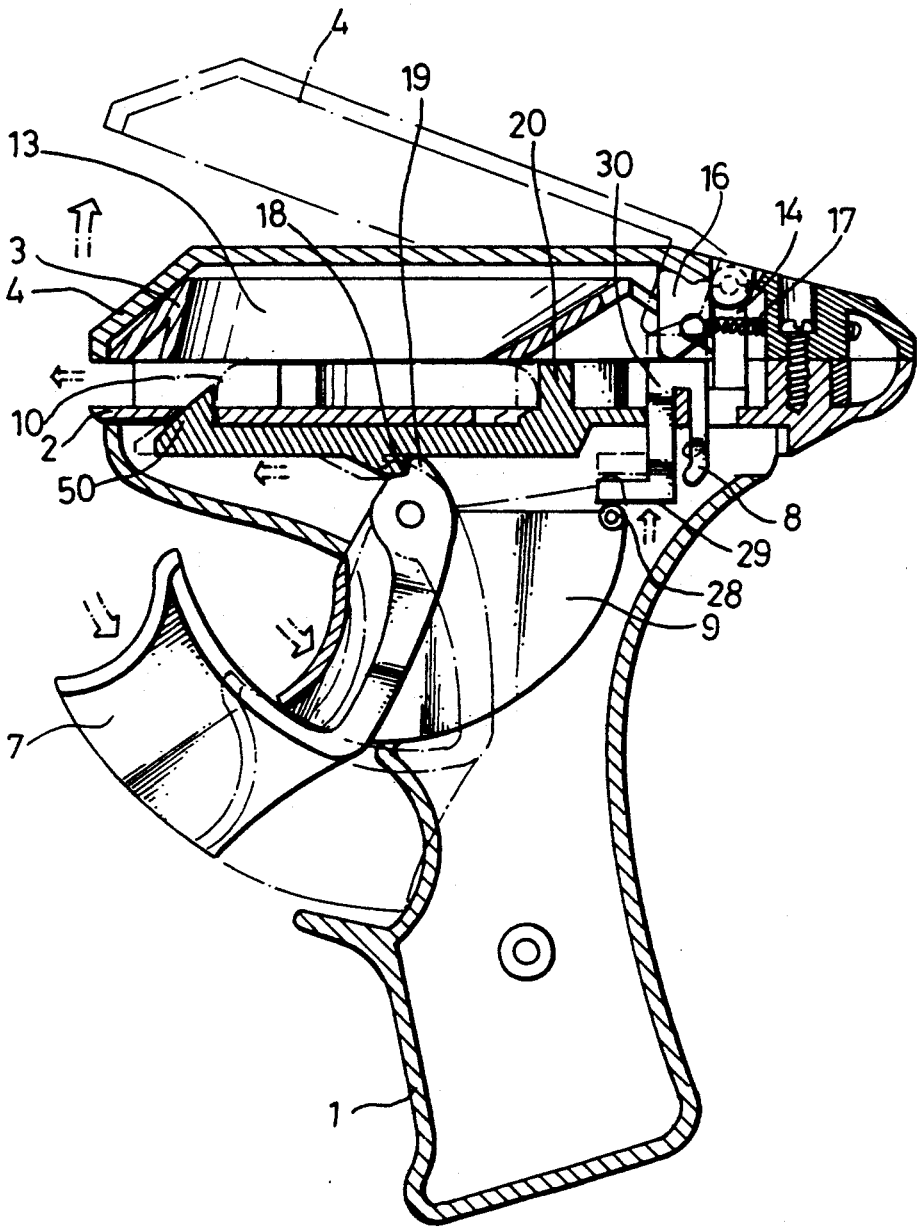
FIG. 4 is a cross section illustrating the operation of the present invention in opening the cover.

Referring to FIG. 4, when the trigger 7 is pulled with the finger, the push plate 5 is immediately pushed by the hooked portion 19 on the trigger 7 causing the two outer circular posts 21, 22 to squeeze the two arm portions 23, 24 of the spring rod 6, and therefore, the toy saucer 10 which is held in the round hole 13 on the saucer seat 3 is launched into the air. Several toy saucers 10 may be placed on the saucer seat 3 with one above another so that they can be continuously launched into the air one after another. When the trigger 7 is released, the spring rod 6 automatically returns to its original shape, and therefore, the push plate 5 is forced to move back the trigger 7. When the auxiliary trigger 9 is pulled with the finger, the lifting plate 8 is moved upwards to lift the projecting strip 16 causing the upper cover 4 to open for catching a flying toy saucer 10 which was launched before. Once the pressure from the finger is released from the auxiliary trigger 9, the two springs 17 at the rear end of the upper cover 4 automatically pull back the upper cover 4 causing the projecting strip 16 to move back the lifting plate 8, and therefore, the auxiliary trigger 9 is moved back to its original position and, the upper cover 4 is pulled to cover on the base 2 again.

What is claimed is:

1. A toy saucer launching and catching device, comprising:

a handle formed of two opposed plastic shells;

a base supported on said handle;

a saucer seat supported on said base for holding toy saucers, said saucer seat having a top surface curving inwards, said top surface having a round hole at the center for guiding toy saucers into a launching position;

an upper cover pivotably closed on said base, said upper cover having two opposite axles longitudinally aligned at a rear end thereof retained in two opposite axle holders, said axle holders being formed in said base and said saucer seat, the rear end of said upper cover having an inward projecting strip at a bottom thereof and a plurality of spring elements connected to said saucer seat, said spring elements being to provide a spring force constantly forcing said upper cover to close said saucer seat and said base;

a push plate movably retained between said base and said saucer seat, said push plate having a hooked portion on a bottom thereof and three circular posts on a top thereof, said three circular posts including a first circular post at the middle, a second circular post and a third circular post at two opposite sides behind said first circular post;

a spring rod mounted on said push plate, said spring rod having two opposite ends bent into two curved arm portions, said two curved arm portion including one disposed between said first circular post and said second circular post, and the other disposed between said first circular post and said third circular post;

a trigger pivoted to said handle, said trigger having a hooked portion stopped against the hooked portion on said push plate;

a lifting plate movably fastened in a hole on said base stopped at said projecting strip on said upper cover;

an auxiliary trigger pivoted to said handle, said auxiliary trigger having a raised portion stopped against said lifting plate;

at least one toy saucer placed in the round hole on said saucer seat with one above another, said at least one toy saucer each having a circular flange around the peripheral surface thereof and a recessed flat surface at the middle; and wherein pulling said trigger with the finger causes said circular posts on said push plate to squeeze said spring rod so that the lowest one of said at least one toy saucer on said saucer seat is launched into the air; pulling said auxiliary trigger with the finger causes said cover to be lifted by said lifting plate for catching a toy saucer which was launched to fly into the air.

* * * * *